US007004858B2

(12) United States Patent
Bauley et al.

(10) Patent No.: US 7,004,858 B2
(45) Date of Patent: Feb. 28, 2006

(54) GOLF BALL MARKER RETAINER AND DIVOT REPAIR DEVICE COMBINATION

(75) Inventors: Craig Ernest Bauley, Tuscon, AZ (US); Rufus Williams, Tucson, AZ (US)

(73) Assignee: Williams & Associates, Tucson, AZ (US)

( * ) Notice: Subject to any disclaimer, the term of this patent is extended or adjusted under 35 U.S.C. 154(b) by 0 days.

(21) Appl. No.: 10/456,966

(22) Filed: Jun. 9, 2003

(65) Prior Publication Data

US 2004/0248674 A1 Dec. 9, 2004

(51) Int. Cl.
*A63B 57/00* (2006.01)

(52) U.S. Cl. ..... 473/408; 473/406

(58) Field of Classification Search ..... 473/285, 473/286, 406, 408

See application file for complete search history.

(56) References Cited

U.S. PATENT DOCUMENTS

| | | | | |
|---|---|---|---|---|
| D247,790 | S | 4/1978 | Jackson | |
| 4,627,621 | A * | 12/1986 | Tate | 473/286 |
| 5,110,123 | A | 5/1992 | Larson | |
| D331,090 | S | 11/1992 | Cellura | |
| 5,244,204 | A * | 9/1993 | Zeller | 473/285 |
| 5,393,052 | A * | 2/1995 | Kennedy | 473/285 |
| 5,529,299 | A * | 6/1996 | Bellagamba | 473/285 |
| 5,769,740 | A * | 6/1998 | Colangelo | 473/408 |
| 6,022,280 | A | 2/2000 | Arenburg et al. | |
| 6,033,322 | A | 3/2000 | England | |
| 6,514,159 | B1 | 2/2003 | Hendren | |

* cited by examiner

*Primary Examiner*—Steven Wong
(74) *Attorney, Agent, or Firm*—Lowe Hauptman & Berner LLP.

(57) ABSTRACT

A combination golf ball marker retention and divot repair device includes a body having an opening for receiving a ball marker, and a divot repair portion. A retaining device in the form of a flexible arm retains a ball marker received through the opening.

20 Claims, 5 Drawing Sheets

GOLF BALL MARKER RETAINER AND DIVOT REPAIR DEVICE COMBINATION

FIELD OF THE INVENTION

The present invention relates to a golf device for divot repair and ball marker retention; and more specifically, to such a device incorporating a positive retaining mechanism and providing feedback to a golfer indicating retention of the ball marker.

BACKGROUND

Golf devices combining a number of tools into a single package are known in the prior art. For example, U.S. Design Patents 247,790 and 331,090 to Jackson and Cellura, respectively, are ornamental designs for combination golf ball marker and divot replacement devices. U.S. Pat. No. 5,110,123 to Larson describes a combined divot repair and ball marker golf device wherein two ball markers are constructed to be joined together and hold the divot repair portion between the joined markers. U.S. Pat. No. 5,393,052 to Kennedy describes a divot repair and ball marker device retaining a ball marker in the body of the device using gravity and U.S. Pat. No. 5,529,299 to Bellagamba describes a divot repair and ball marker device retaining a ball marker in the body of the device using a natural pressure from a slight expansion of a supporting slot holding the marker. U.S. Pat. No. 6,022,280 to Arenburg et al., U.S. Pat. No. 6,033,322 to England, and U.S. Pat. No. 6,514,159 to Hendren describe golf devices combining divot repair and ball maker retention capabilities wherein the ball marker is retained using magnetism.

With the exception of the '123 patent to Larson in which two ball markers are combined to form the marker retention device, each of the above combination golf devices include an elongated body having a pair of prongs at one end for use in divot repair connected to a ball marker retention mechanism at the other end. The devices are generally flat and small enough to be carried in a person's hand or fit in a shirt or pant pocket. The body is generally flat and includes a front and rear face connected by a narrower side wall.

One problem associated with prior approaches is a lack of positive retention force on golf ball markers being held by a golfer. Typically, golfers use a small, and relatively flat disc-shaped device to mark a golf ball location during game play. The ball marker is small in order to minimize the possibility of contact with another golfer's ball in motion. The ball marker is relatively flat to minimize the amount of impact to the path of another golfer's ball if contact occurs. Without a retaining force holding the marker in place, the marker is likely to slide out or otherwise become detached from a holder necessitating delay of game play until a suitable alternative may be found and likely agitating the golfer due to losing a particular marker. With respect to the '052 patent to Kennedy, the only marker retaining force is gravity; the marker will fall out if the device is upended. With respect to the '090, '280, '322, and '159 patents, it is likely that the marker will be forced out of the retention mechanism by inadvertent application of force to the backside of the marker while installed in the device.

Another problem associated with prior approaches is a lack of feedback to the golfer upon insertion of the ball marker in the ball marker retention mechanism. Under previous approaches, the golfer must look at the golf device in order to be certain the marker is retained therein.

Further, with respect to the '052 patent to Kennedy, the golfer is not assured of ball marker retention in the device without careful handling of the device because if the device is turned upside down, the ball marker will fall out of the c-shaped recess. With respect to the '299 patent to Bellagamba, the golfer is not assured of ball marker retention in the device as there is no indication provided by the device to the golfer that sufficient pressure has been applied to wedge the marker in the device. Further problematically, over time it is possible that even a tightly wedged marker in the device according to the '299 patent will work free and fall out of the device.

With respect to the magnetic-based retaining mechanism (used in the '280 patent to Arenburg et al, the '322 patent to England, and the '159 patent to Hendren), the above problem related to providing feedback to the golfer applies, as well. That is, even if the golfer hears a click sound indicating contact between the ball marker and the magnetic portion of the marker retention mechanism, there is no assurance that the marker is properly seated in the retention mechanism, thereby necessitating another time-consuming visual check of the device by the golfer.

There is a need in the art for a positive ball marker retention mechanism. Further, there is a need in the art for such a positive retention mechanism providing a feedback to a golfer indicating retention of the ball marker.

Additionally, because of the small size of the device, golfers are prone to dropping or otherwise losing the device. Loss of the device and attached ball marker involves agitation of the golfer and distraction during game play. Further, time is lost and greater distraction arises when the golfer casts about for a suitable replacement for, at a minimum, the ball marker. It would be beneficial to enable the golfer to attach or clip the device to the golfer's garments or golf bag for quick and easy access during game play.

Due to the size and need for ready access to such frequently used golf devices, there is a need in the art for a mechanism for attaching the device to other accessories or to a golfer's garments for quick access during game play.

Further, it is sometimes necessary to adjust, e.g. tighten or loosen, golf shoe spikes during the course of game play. It would be beneficial to provide a mechanism for adjusting golf spikes without requiring the golfer to carry a separate tool.

SUMMARY

It is therefore an object of the present invention to provide a positive ball marker retention mechanism.

Another object of the present invention is to provide feedback to a golfer indicating retention of the ball marker.

Another object of the present invention is to provide a mechanism for attaching a ball marker device to other accessories or a golfer's garments for ready access.

Another object of the present invention is to provide a mechanism for adjusting golf spikes without requiring a separate tool.

The present invention provides a combination golf ball marker retention and divot repair device including a body having an opening for receiving a ball marker, and a divot repair portion. A retaining device in the form of a flexible arm retains a ball marker received through the opening.

In one apparatus aspect, the combination golf ball marker retention and divot repair device includes a body having an opening for receiving a ball marker into an internal cavity of the body, a divot repair portion, and a retaining device. The retaining device is a flexible arm for retaining a ball marker received through the opening. In a specific embodiment, the flexible arm is a C-shaped retaining clip.

In another apparatus aspect, the combination golf ball marker retention and divot repair device includes a body having an opening for receiving a ball marker into an internal cavity of the body, a divot repair portion, and a retaining device. The retaining device is a pair of opposed flexible arms for retaining a ball marker received through the opening.

In another apparatus aspect, a golf ball marker retention device includes a body having a slotted opening for receiving a ball marker into an internal cavity of the body and a retaining device for retaining the ball marker received through the slotted opening. The retaining device in the form of a flexible arm is positioned adjacent the slotted opening and inside the internal cavity. The flexible arm is positioned to contact a ball marker received through the slotted opening.

In a method aspect, a ball marker is retained in an internal cavity of a marker retention device. A ball marker is inserted into a slotted opening of the retention device and into contact with an arm end of a flexible arm positioned adjacent the slotted opening. Force is applied to the ball marker causing the contacting arm to flex away from the ball marker and the marker to slide past the arm end. After the centerpoint of the ball marker slides past the arm end, the arm is able to return to an unflexed position and in so doing applies force to the ball marker causing the marker to move fully into the internal cavity of the marker retention device.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention.

DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION

Figure 1:
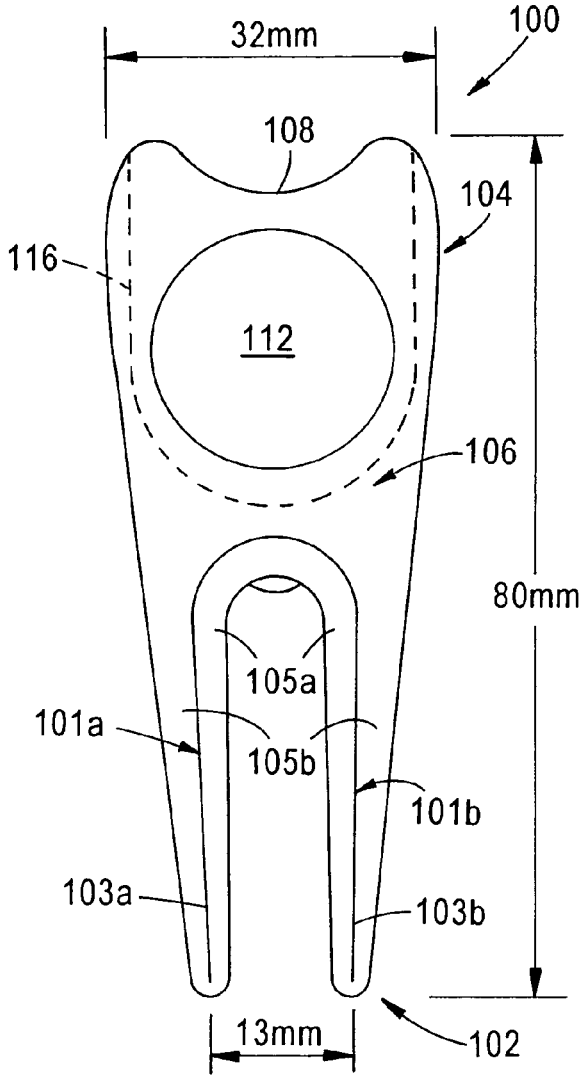
FIG. 1 is a front face view of an embodiment of the present invention.

FIG. 1 depicts a front face view of a divot tool and ball marker retention device 100 according to an embodiment of the present invention. Device 100 is an elongated two pronged shape small enough to fit in a shirt pocket. A first portion 104, generally located at the upper end of device 100, is generally flat and may include a concave-shaped depression 108 opening in a direction away from a second portion 102, generally located at a lower end of device 100, to receive a ball marker. Device 100 includes two substantially parallel prongs 101*a* and 101*b* at second portion 102, for use in repairing divots on a golf course. In accordance with a unique feature of this invention, a ball marker retention mechanism 120, described more fully below, is operationally associated with the depression 108 to positively secure the ball marker within the device 100.

Figure 2:
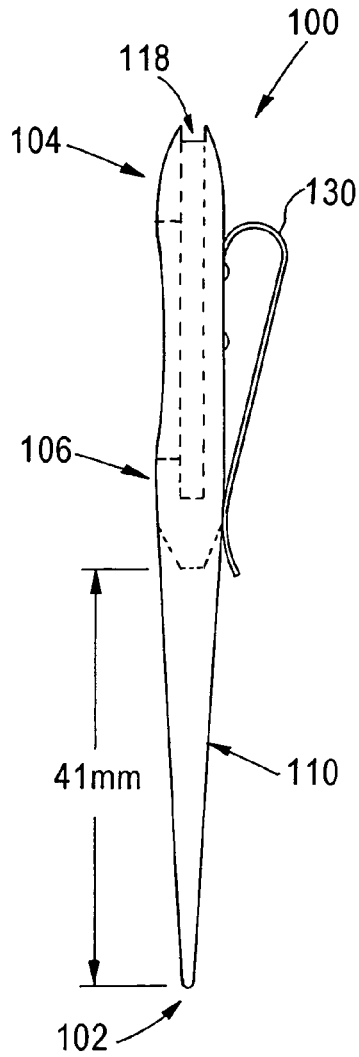
FIG. 2 is a right side view of the FIG. 1 embodiment of the present invention.
Figure 4:
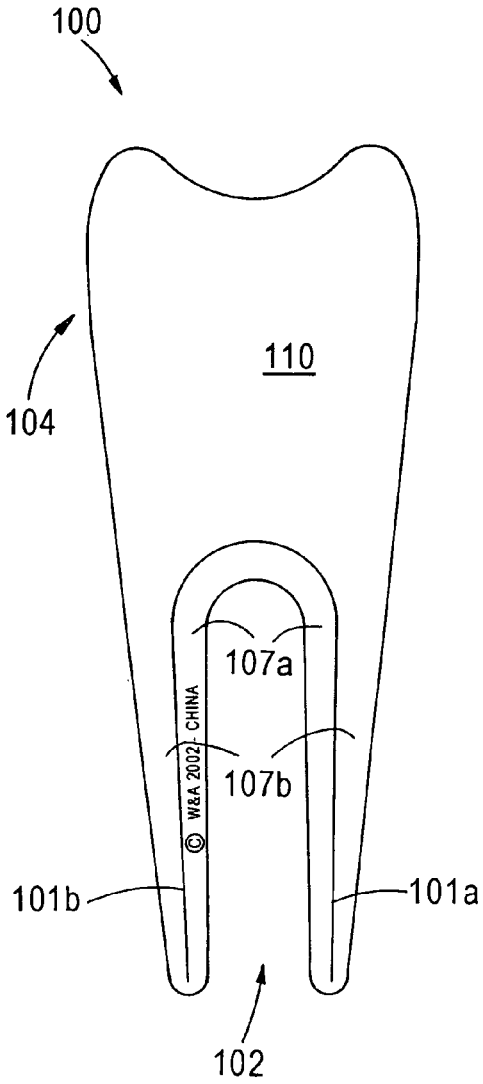
FIG. 4 is a rear face view of the FIG. 1 embodiment of the present invention.

As illustrated with reference to FIG. 2, device 100 has a front face 106 and a rear face 110. Rear face 110 is additionally illustrated in the rear view of the present embodiment in FIG. 4.

Device 100 is widest at the first portion 104 and tapers to a narrower width at the lower end of the prongs of second portion 102. Prongs 101*a* and 101*b* include sloped regions 105*a*, 105*b* on the front face 106 in which the width of the prongs narrows moving away from the centerline 103*a*, 103*b* of the prongs and at the joining region of the upper portion of the prongs. Rear face 110 includes similar sloped regions 107*a* and 107*b* along prongs 101*a* and 101*b* and the joining region of the upper portion of the prongs, i.e. the region closest to first portion 104. Operation of device 100 using prongs 101*a* and 101*b* as a divot repair tool is as known in the art of golf.

In one particular embodiment, device 100 is approximately eighty millimeters (80 mm) in length and thirty two millimeters (32 mm) wide at upper end 104 and thirteen millimeters (13 mm) wide at the center point of prongs 101*a* and 101*b* at the lower end of second portion 102. In the same embodiment, prongs 101*a* and 101*b* are approximately forty one millimeters (41 mm) in length.

Advantageously, the prong separation distance enables use of device 100, specifically prongs 101*a* and 101*b*, to optionally be used to adjust golf shoe spikes. The prongs 101*a*, 101*b* may be used to tighten shoe spikes which may have loosened during game play or loosen spikes needing to be replaced without requiring retrieval of another tool and any attendant time delay.

Figure 3A:
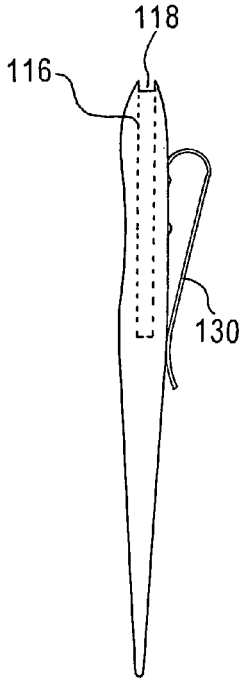
FIG. 3*a* is another right side view of the FIG. 1 embodiment of the present invention.

First portion 104 of front face 106 includes a through-hole 112 for viewing a ball marker (114 of FIG. 3*c*) inserted and retained in device 100. Although in a preferred embodiment, through-hole 112 is a circular shape, it is contemplated that through-hole 112 may be formed in a different shape, e.g. rectangular, elliptical, or other rounded or polygonal shape. Through-hole 112 provides an opening through front face 106 of device 100 to view ball marker 114. By way of through-hole 112, logos, marketing text, or other information imprinted on or otherwise comprising a part of ball marker 114 are visible to a golfer while the ball marker is retained in device 100. Through-hole 112 is smaller than ball marker 114 thereby preventing the marker from inadvertently passing through through-hole 112.

Device 100 further includes an internal cavity 116 (dashed line) for receiving ball marker 114. Internal cavity 116 opens to the exterior of device 100 via (1) an entrance opening or slot 118 formed at first portion 104 and (2) through-hole 112. Slotted opening 118 is large enough to allow for the insertion (in a direction indicated by reference character A of FIG. 3*c* which is parallel to the faces 106, 110) and removal (opposite the direction A) of ball marker 114 from cavity 116. It is to be understood that, in alternate embodiments, slotted opening 118 may be in a different portion of device 100, e.g. along one side of first portion 104 of device 100. As described above, the size of through-hole 112 prevents passage of ball marker 114 through the through-hole.

Retaining Device

Figure 3B:
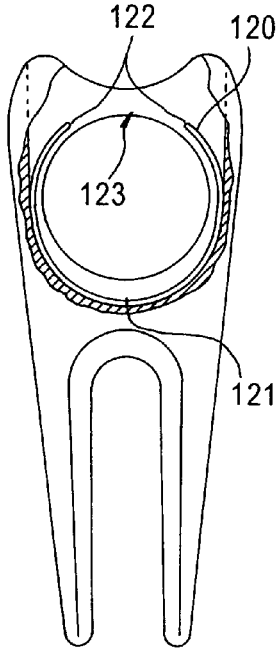
FIG. 3*b* is a cut-away rear face view of the FIG. 1 embodiment of the present invention.
Figure 3C:
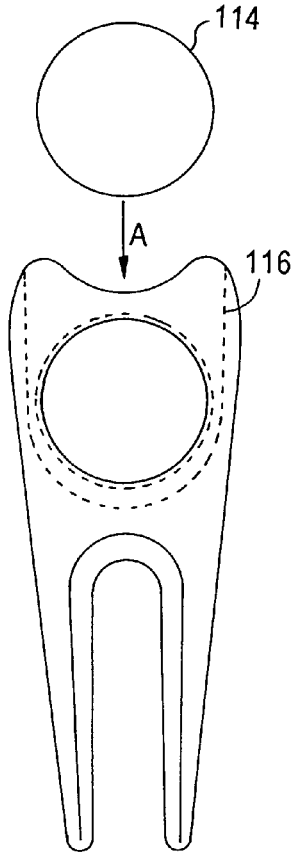
FIG. 3*c* is a front face view of the FIG. 3*b* embodiment of the present invention.

FIG. 3*b* depicts a cut-away rear face view of the FIG. 1 embodiment having a pocket clip 130 (FIG. 3*a*) removed for clarity. With reference to FIG. 3*b*, internal cavity 116 includes a retaining device 120 for retaining ball marker 114 within the cavity. In one particular embodiment, retaining device 120 is a C-shaped clip made of spring steel wire. It is to be understood that in alternate embodiments, the C-shaped clip may be made of other materials providing the flexible capability, e.g. plastic. Retaining device 120 is attached to internal cavity 116 at a point 121 generally opposite the slotted opening 118 and opposite the retaining device opening generally indicated by reference numeral 123. Retaining device 120 may be attached at attachment point 121 by soldering or other suitable attaching mechanism, e.g. fasteners or glue. Retaining device opening 123 is smaller than ball marker 114 in order to positively retain the marker in the device 100. Retaining device 120 and retaining device opening 123 are aligned in the same direction as internal cavity 116 and slotted opening 118 to the internal cavity.

Figure 8:
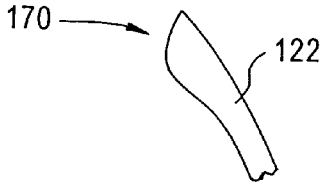
FIG. 8 is a detailed view of a portion of a retaining device used in conjunction with an embodiment of the present invention.

With reference to FIG. 8, the distal ends of arms 122 are rounded, as generally indicated by reference numeral 170, to facilitate insertion of ball marker 114 into internal cavity 116. The rounding of arm 122 ends eases sliding of arms 122 along the periphery of marker 114.

Attaching the retaining device 120 opposite the C shape opening allows flexure of arms 122 forming the opening 123 of the C shape of retaining device 120. In this manner, insertion of ball marker 114 forces the arms 122 in a direction away from each other until the widest portion (i.e. the diameter) of the ball marker passes the arm ends at which point the arms resiliently move in a direction toward each other in order to return to the original shape while enclosing around to positively capture and retain the marker within the cavity by blocking the slotted opening 118. After the ball marker 114 widest point passes the arms, movement of the arms 122 to the original position applies force to the ball marker forcing the marker into position in internal cavity 116.

More specifically, the force applied to ball marker 114 propels the marker into contact with the lower end of cavity 116, i.e. the end furthest from opening 108. Ball marker 114 contacting cavity 116 makes an audible click sound indicating retention of the maker in the internal cavity. In this manner, the golfer is assured that marker 114 is positively retained in device 100 without having to look at device 100.

With ball marker 114 in position to be inserted in slotted opening 118, i.e. marker in contact with the upper edge of arms 122, approximately one third of the marker face is visible outside device 100 and approximately one third of the marker face is visible via through-hole 112.

Pocket Clip

In one embodiment, device 100 includes a pocket clip 130 attached to the rear face 110 for clipping the device to a shirt or pants pocket. Pocket clip 130 is a spring steel wire clip attached at one end to first portion 104 of device 100 and curves away from rear face 110 and back on itself to contact the device at a point below the attachment point of the pocket clip. In an alternative embodiment, pocket clip 130 may also be used as a money clip for holding paper currency.

Ball Marker

Figure 5A:
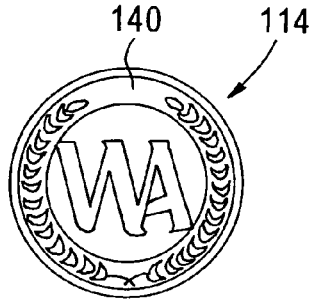
FIGS. 5*a* and 5*b* are front and rear face views, respectively, of a ball marker usable in conjunction with an embodiment of the present invention.
Figure 5B:
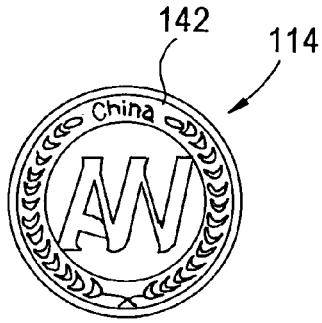

FIGS. 5*a* and 5*b* illustrate, respectively, the front face 140 and rear face 142 of ball marker 114. Ball marker 114 is a metallic disc-shaped marker approximately twenty three millimeters (23 mm) in diameter and approximately 2.2 millimeters thick. In alternate embodiments, marker 114 may be different dimensions and made of other materials, e.g. plastic, wood. Front face 140 includes a logo as a form of advertising and may include other images or text as desired. As the front face logo is not solid, rear face 142 includes the reverse of the logo on front face 140. In alternate embodiments, front face 140 and rear face 142 may both be solid and include different images or text or the same images and text on each face.

Device Operation

Figure 9A:
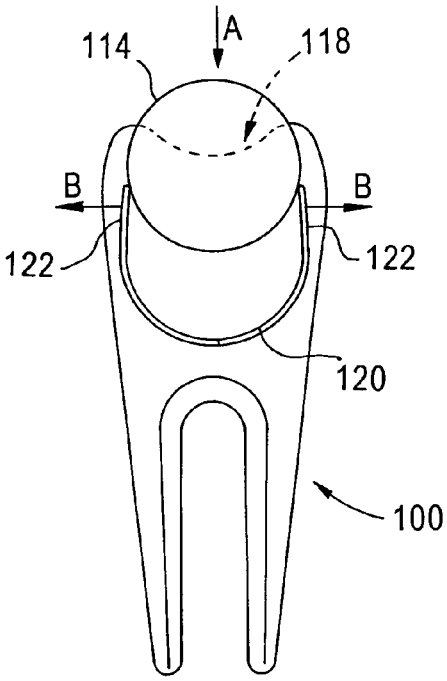
FIGS. 9*a*–9*e* are a sequential depiction of the insertion and removal of a ball marker in a ball marker retention device according to an embodiment of the present invention.
Figure 9B:
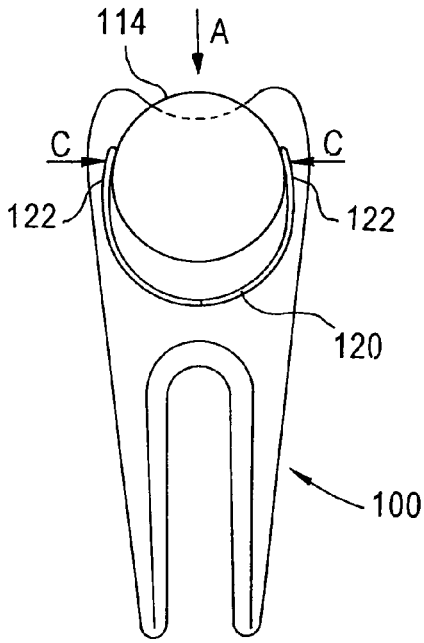
Figure 9C:
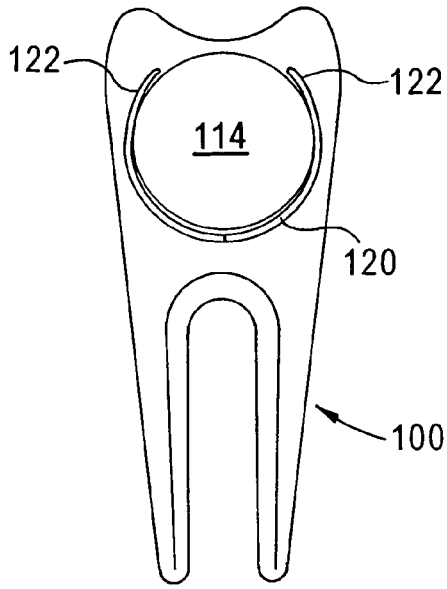
Figure 9D:
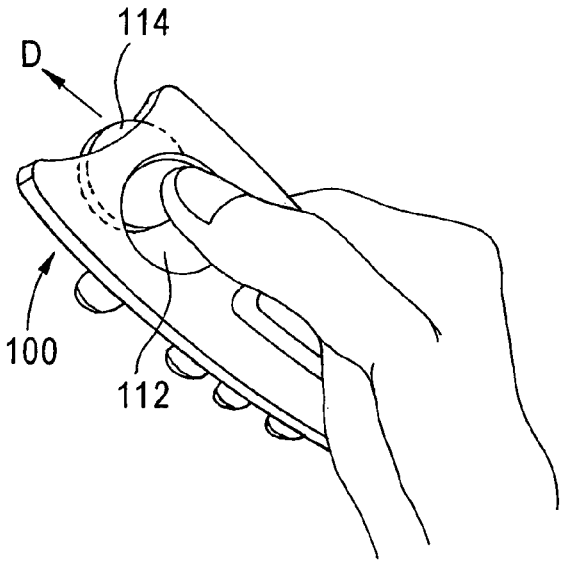
Figure 9E:
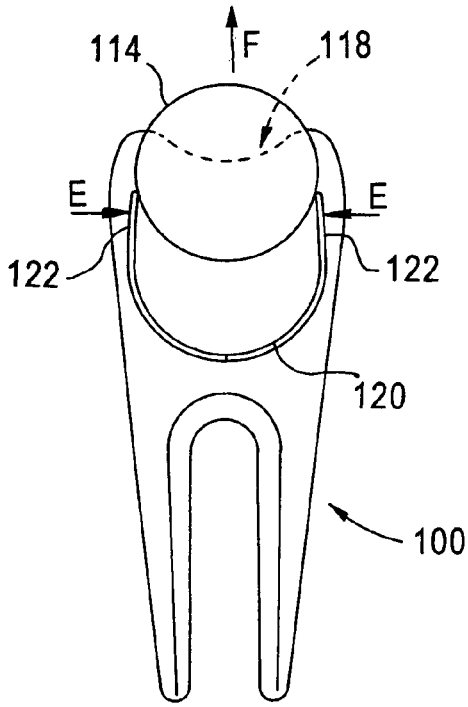

In operation and as depicted in FIGS. 9*a*–9*e*, ball marker 114 is inserted in slotted opening 118 in the top of first portion 104 and retained via ball marker retaining device 120 as described above in conjunction with FIG. 3*b*. As ball marker 114 is moved into internal cavity 116 (direction A), retaining device 120 arms 122 are pushed apart (direction B) by insertion of marker 114 (FIG. 9*a*). After the center point of marker 114 passes arms 122, the arms move toward each other (direction C) and apply force to move the marker further into cavity 116 (FIG. 9*b*).

With marker 114 situated in internal cavity 116 (FIG. 9*c*), a golfer desiring to remove the marker uses a fingertip or thumb to push the marker out through slotted opening 118 past the flexing arms 122 of retaining device 120. The golfer applies force to a face of marker 114 (dashed line, FIG. 9*d*), either front face 140 or rear face 142 depending on the orientation of ball marker 114 in internal cavity 116, through through-hole 112 to slide the marker out of device 100 (direction D, FIG. 9*d*) via slotted opening 118.

Similar to the procedure for inserting marker 114 into device 100, as the widest portion of marker 114 passes retaining arms 122, the arms in returning (direction E, FIG. 9*e*) to the non-flexed position apply a force to the marker thereby propelling (direction F, FIG. 9*e*) the marker out of slotted opening 118. The speed at which ball marker 114 exits slotted opening 118 depends upon the amount of downward force applied by the golfer to the marker. For example, a golfer may apply sufficient downward force to slide marker 114 slightly beyond arms 122 and release the marker allowing the force of the returning arms 122 to expel the marker through opening 118, i.e. the marker 114 "shoots" out of opening 118 due to the spring-like tension of arms 122 being released. In this manner, a golfer is able to control whether ball marker 114 is forcefully expelled from device 100, e.g. into the hand of the golfer, or made available for removal from opening 118 by the golfer using the same or other hand.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

For example, although not shown in the present embodiment, it is within the scope of the present invention to extend through-hole 112 completely through device 100 by extending the through-hole through rear face 110. Advantageously, in this form, both front 140 and rear faces 140, 142 of marker 114 are visible to the golfer. In this embodiment, pocket clip 130 may either be removed or repositioned on rear face 110 of device 100.

Figure 6:
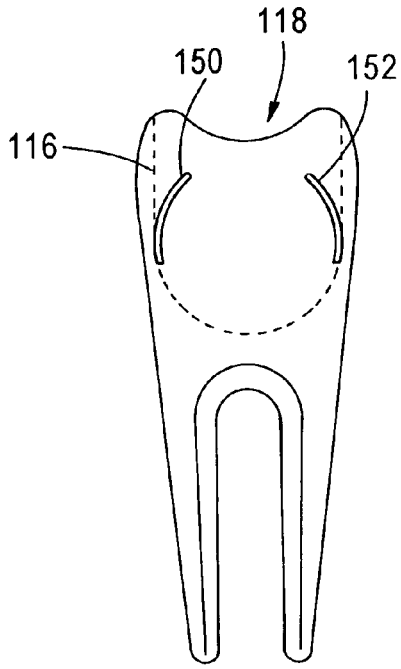
FIG. 6 is a cut-away front view of a second embodiment of the present invention.

In another embodiment, retaining device is made up of two flexible arms 150, 152 affixed at either side of the opening 118 and within internal cavity 116 as illustrated in FIG. 6. Flexible arms 150, 152, operating in a manner similar to arms 122 described above, move apart and toward each other during insertion and removal of marker 114 into cavity 116.

Figure 7:
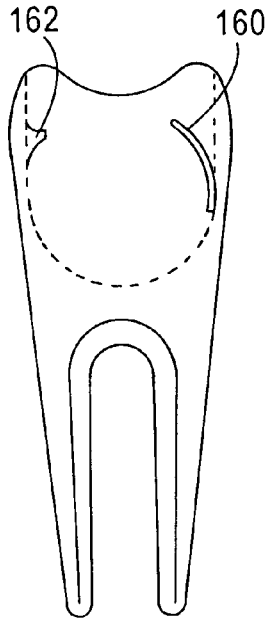
FIG. 7 is a cut-away front view of a third embodiment of the present invention.

In a still further embodiment, a single flexible arm such as arm 160 of FIG. 7 is employed in conjunction with either a stationary arm or a modified shape of internal cavity 116, e.g. a ridge 162, to enable insertion and removal of marker 114 similar to the operation of device 100 described above.

Advantageously, a ball marker retention and divot repair device according to the present invention enables a golfer to easily and rapidly remove and place a ball marker using a single hand.

What is claimed is:

1. A combination golf ball marker retention and divot repair device, comprising:

a body comprising:

a first portion having a slotted opening for receiving a ball marker into an internal cavity of the body;

a second portion having a divot repair portion; and a retaining device for retaining a ball marker received through the slotted opening, wherein the retaining device comprises:

a flexible arm positioned adjacent the slotted opening and inside the internal cavity, wherein the flexible arm is positioned to contact a ball marker received through the slotted opening.

2. The device as claimed in claim 1, wherein the retaining device is affixed to the internal cavity of the body.

3. The device as claimed in claim 1, wherein the flexible arm comprises:

a C-shaped retaining clip having an opening for receiving a ball marker.

4. The device as claimed in claim 3, wherein the retaining clip is positioned such that the retaining clip opening is adjacent the first portion opening.

5. The device as claimed in claim 1, wherein the retaining device is metallic.

6. The device as claimed in claim 1, wherein the first portion includes a second opening in a front face of the first portion to display a face of a retained ball marker.

7. The device as claimed in claim 6, wherein the first portion includes a third opening in a rear face of the first portion opposite the second opening to display another face of the retained ball marker.

8. The device as claimed in claim 1, wherein the device includes a clip attached to a rear face of the first portion of the device.

9. The device as claimed in claim 8, wherein the clip is at least one of a pocket clip and a money clip.

10. The device as claimed in claim 1, wherein the flexible arm of the retaining device is affixed to a side wall of the internal cavity of the device body.

11. The device as claimed in claim 1, wherein the flexible arm of the retaining device is affixed to a bottom wall of the internal cavity of the device body.

12. The device as claimed in claim 1, wherein the flexible arm is adapted to propel an inserted ball marker into contact with the internal cavity by moving from a flexed to unflexed position.

13. The device as claimed in claim 12, wherein the arm and internal cavity are arranged such that arm propelled ball marker contact with the internal cavity generates a click sound indicative of insertion of ball marker in the internal cavity.

14. The device as claimed in claim 1, wherein the ball marker contacting end of the flexible arm is rounded to facilitate insertion of the ball marker into the internal cavity.

15. The device as claimed in claim 1, wherein the second portion includes a pair of prongs extending away from the upper portion for use in divot repair.

16. The device as claimed in claim 15, wherein the pair of prongs extend parallel to each other.

17. The device as claimed in claim 15, wherein the inner separation distance between the pair of prongs is the diameter of a shoe spike.

18. A combination golf ball marker retention and divot repair device, comprising:

an elongated body comprising:

an upper portion having an opening for receiving a ball marker into an internal cavity of the body;

a lower portion having a divot repair portion; and a retaining device for retaining a ball marker received through the upper portion opening, wherein the retaining device comprises:

a pair of opposed flexible arms positioned adjacent the opening and inside the internal cavity of the device body, wherein the pair of opposed flexible arms are positioned to contact the ball marker received through the opening.

19. The device as claimed in claim 18, wherein the pair of opposed flexible arms are attached to opposite side walls of the internal cavity of the device body.

20. The device as claimed in claim 18, wherein the pair of opposed flexible arms are attached to the bottom of the internal cavity of the device body.

* * * * *